United States Patent [19]

Aurand

[11] Patent Number: 4,722,387

[45] Date of Patent: Feb. 2, 1988

[54] HEAT EXCHANGER AND METHOD OF ASSEMBLY

[75] Inventor: Gene W. Aurand, Redondo Beach, Calif.

[73] Assignee: The Garrett Corporation, Los Angeles, Calif.

[21] Appl. No.: 830,316

[22] Filed: Feb. 18, 1986

[51] Int. Cl.[4] ..... F28F 9/02

[52] U.S. Cl. ..... 165/153; 165/173

[58] Field of Search ..... 165/153, 173; 248/65

[56] References Cited

U.S. PATENT DOCUMENTS

| | | | |
|---|---|---|---|
| 879,243 | 2/1908 | Bush | 165/153 |
| 966,721 | 8/1910 | Todd | 165/153 |
| 1,588,348 | 6/1926 | Farris | 165/153 |
| 1,657,359 | 1/1928 | Hendrix | 165/153 |
| 2,356,919 | 8/1944 | Dono et al. | 165/173 |
| 2,899,177 | 8/1959 | Harris et al. | 165/153 |
| 3,775,972 | 12/1973 | Perpall | 165/173 X |
| 3,866,675 | 2/1975 | Bardon et al. | 165/173 |

FOREIGN PATENT DOCUMENTS

| | | | |
|---|---|---|---|
| 793525 | 4/1958 | United Kingdom | 165/153 |

*Primary Examiner*—William R. Cline
*Assistant Examiner*—Randolph A. Smith
*Attorney, Agent, or Firm*—J. Henry Muetterties; Albert J. Miller

[57] ABSTRACT

A heat exchanger of the type characterized by a plurality of heat exchanger tubes separated by cooling fins. The ends of the tubes being inserted into a leadless header plate and thereafter brazed thereto. The overall depth of the heat exchanger being approximately equal to the width of the heat exchanger tube plus twice the thickness of the material of the header plate. Heat exchange tube ends being inserted into slots formed in the header plate by use of an alignment tool.

10 Claims, 11 Drawing Figures

HEAT EXCHANGER AND METHOD OF ASSEMBLY

BACKGROUND OF THE INVENTION

The present invention relates to heat exchangers and their method of manufacture and more particularly to an intercooler or charge air cooler having a leadless header plate and the method of assembling the heat exchanger core having a leadless header plate therein.

In turbocharged vehicles, the turbocharger utilizes an exhuast gas driven turbine to compress ambient air for supply to the engine. The greater the amount of compressed air supplied to the engine the greater the fuel efficiency and/or engine power output. However, compression causes the air to increase in temperature, thereby decreasing its density. In order to increase the compressed air density, an intercooler or charge air cooler is used to cool the compressed air discharged from the turbocharger before it is delivered to the engine.

Vehicle manufacturers dictate the location and size of under-the-hood accessories supplied by manufacturers of these components. Therefore, once the particular space limitations are placed upon the supplier, it is of utmost importance to design a component which fits within that space limitation(s) and meets the vehicle manufacturers performance requirements. In the present case, once given the space limitations on the intercooler, it is important to maximize the heat transfer characteristics in order to maximize the cooling of the compressed air supplied to the engine.

SUMMARY OF THE INVENTION

The present invention is directed to an intercooler or charge air cooler which maximizes heat exchanger tube width and therefore heat exchange rate per a given space. This maximization is made possible by the use of a leadless header plate which permits maximization of heat exchanger tube area for any given space. The leadless header plate is generally flattened U-shaped and comprises a generally flat base having two legs. The base has a plurality of slots running the width of the base from leg to leg. The overall width of the leadless header plate being approximately the length of the slot plus twice the thickness of the material used to construct the leadless header plate.

A heater core sub-assembly comprising a plurality of elongated heat exchange tubes separated by cooling fins is preassembled. The sub-assembly is fitted with a leadless header plate at each end and thereafter brazed together to form a heater core. Manifolds and end plates are added to complete the heat exchanger.

Attachment of a leadless header plate to the sub-assembly is accomplished through the use of an alignment tool and the method outlined below. The alignment tool comprises two identical halves, which when mated, form alternating webs and slots. The alignment tool slots are formed to correspond in size and location with the header plate slots. On the top side of the alignment tool, the transition from each web to each slot is tapered in order to guide the tube end onto its respective slot. The bottom of the alignment tool is tapered to conform to the bend radius of the U-shaped leadless header plate.

According to the method of attachment of the present invention, the slotted header plate is located on a base fixture by retractable locating pins. The alignment tool halves are joined so that the halves are properly located over the slotted leadless header plate. Each slot in the alignment tool being of equal size and being aligned atop a slot in the header plate. Clamps are applied to hold the alignment tool and header plate to the base fixture. The locating pins are then retracted. A sub-assembly is placed on or held above, in an aligned position, the alignment tool. A press is activated which presses the open ends of the heat exchanger tubes through the tapered section and then on through the alignment tool and into the slots in the leadless header plate. Thereafter, the clamps and alignment tool are retracted so that the attachment of a second leadless header plate can be repeated on the other end of the heater core sub-assembly. Leadless header plates are thereafter brazed to the sub-assembly at the interface of the header plate and heat exchanger tubes.

It is an object of this invention to provide a heat exchanger header plate design which maximizes the width of the heat exchanger tube which can be used with any given heater plate width.

It is an object of this invention to provide an alignment tool which permits easy attachment of a leadless header plate of the present invention to a heat exchanger core subassembly of a plurality of heat exchanger tubes and cooling fins.

It is another object of this invention to provide an intercooler for use in combination with a turbocharged engine.

It is another object of this invention to provide a method of attaching the leadless header plate of the present invention to a heat exchanger core sub-assembly including a plurality of alternating heat exchanger tubes and cooling fins.

BRIEF DESCRIPTION OF THE DRAWINGS

FIG. 3A is a cross-sectional view of the leadless header plate taken along line A—A of FIG. 3.

FIG. 3B is a cross-sectional view of the leadless header plate taken along line B—B of FIG. 3 and having a tube inserted therein.

DESCRIPTION OF THE INVENTION

Figure 1:
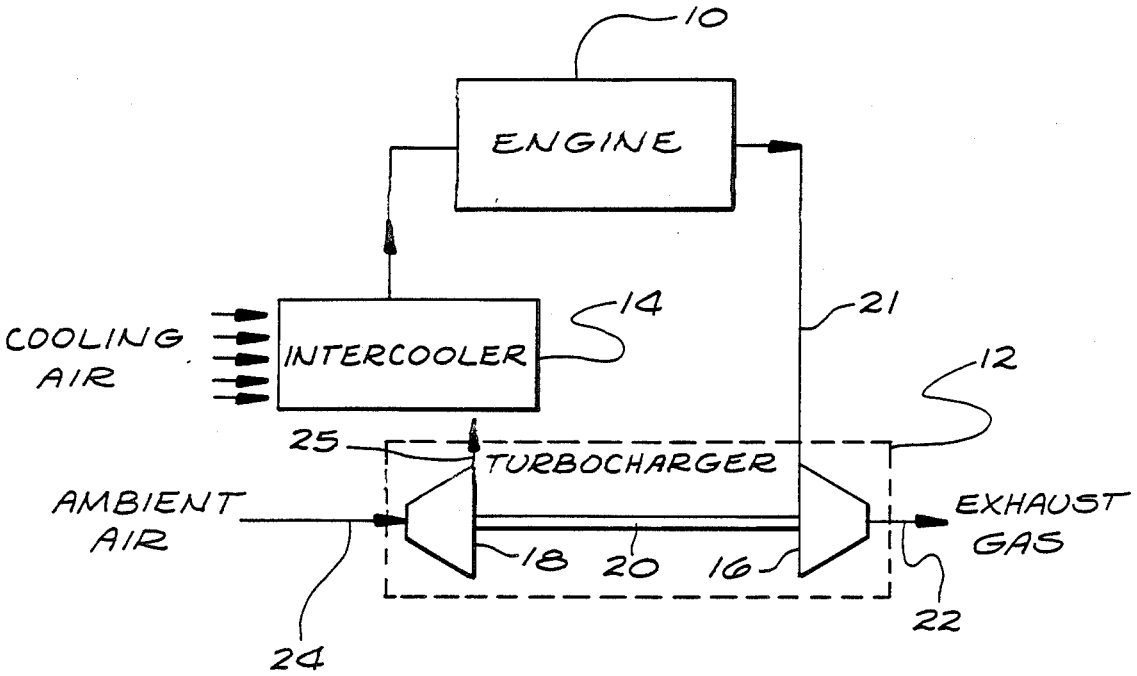
FIG. 1 is a schematic diagram of a turbocharged engine system utilizing an intercooler.

Shown in FIG. 1 is a turbocharged engine system which includes an engine 10, a turbocharger 12 and an intercooler or charge air cooler 14. The turbocharger 12 generally comprises an exhaust gas driven turbine 16 and a compressor 18 simultaneously driven by a common shaft 20 all within suitable housings. The turbine includes an inlet 21 for receiving exhaust gas from the engine 10 and an outlet 22 for discharging exhaust gas. The compressor 18 includes an inlet 24 for drawing in ambient air to be compressed and outlet 25 for directing compressed air to the intercooler 14. Utilizing the cooler ambient air, the intercooler 14 cools the compressed air discharged from the compressor for delivery to the engine 10.

Figure 2:
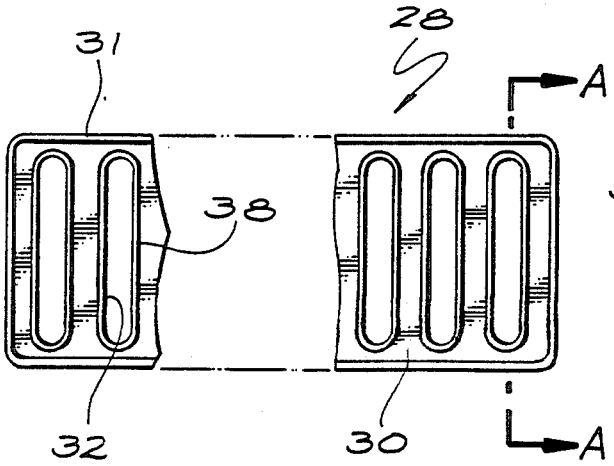
FIG. 2 PRIOR ART
FIG. 2 is a partial, top cross-sectional view of a conventional header plate of a heat exchanger.
Figure 2A:
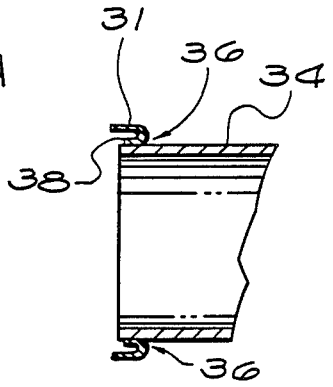
FIG. 2A PRIOR ART
FIG. 2A is a cross-sectional of the header plate taken along line A—A of FIG. 2 and having a tube inserted therein.

FIG. 2 shows a conventional header plate 28 for use in a heat exchanger or the like. Conventional header plate 28 consists of a base section 30 defining a plurality of slots 32 therein and a continuous flange 31 therearound. FIG. 2A shows the cross-sectional end view of the conventional header plate 28 having a heat exchanger tube 34 inserted therein. Each slot 32 is formed by bending the plate material back over itself forming a radius and a lip or overlapping portion 38 approximately one-half the height of the conventional header plate. Heat exchanger tubes 34 are then inserted into the slots 32 and braze welded to the header plate 28 at the annular interface 36 between the overlapping portion 38 and the heat exchanger tube 34 as shown in FIG. 2A.

Furthermore, most conventional header plates have slots which are larger than the heat exchanger tubes. This is done for ease of insertion of the tube ends into the slots. After insertion, the tube ends are outwardly deformed to the size of the header plate slots. Brazing of the tubes to the header plate may then be necessary to seal the interface between the two.

DETAILED DESCRIPTION OF THE PREFERRED EMBODIMENT

Figure 3:
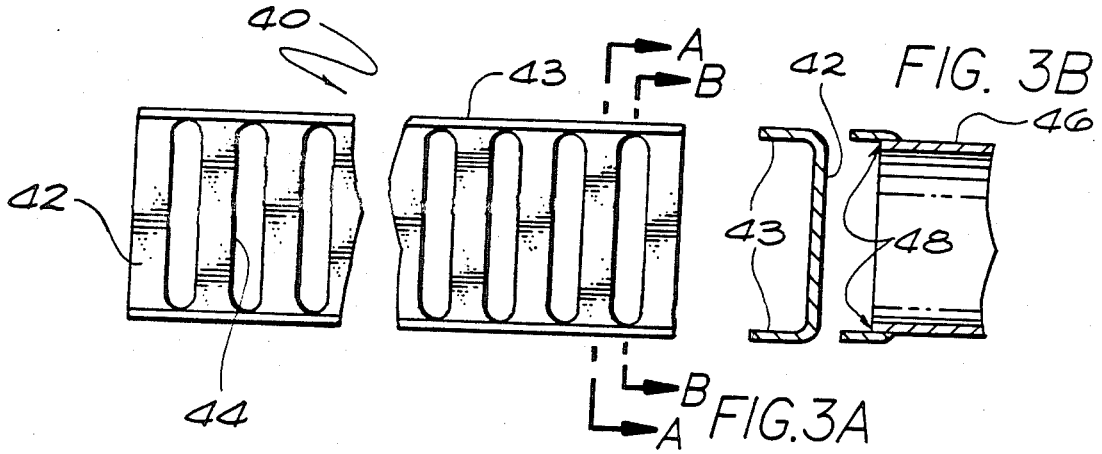
FIG. 3 is a partial, top cross-sectional view of a leadless header plate of a heat exchanger according to the present invention.

Referring to FIGS. 3–7, and more particularly to FIG. 3, shown is the leadless header plate 40 of the present invention. Leadless header plate 40 is generally elongated, U-shaped having a generally flat surfaced base 42 and legs 43 on each side running the length of the header plate 40. Base 42 defines a plurality of slots 44 therein for insertion of heat exchanger tubes 46. Slots 44 run the entire width of the leadless header plate base 42. This features ensures that the header plate's overall width is as small as possible for reduction of total size of the unit. As shown, the width is approximately equal to the length of the slot plus twice the thickness of the material which is used to construct the header plate.

As shown by FIG. 3B, after insertion of heat exchanger tube 46, the tube can be brazed to the base 42 annularly about the base material defining the slots and to the legs 43 of header plate 40 at the ends of the tubes, see reference numeral 48.

Figure 4:
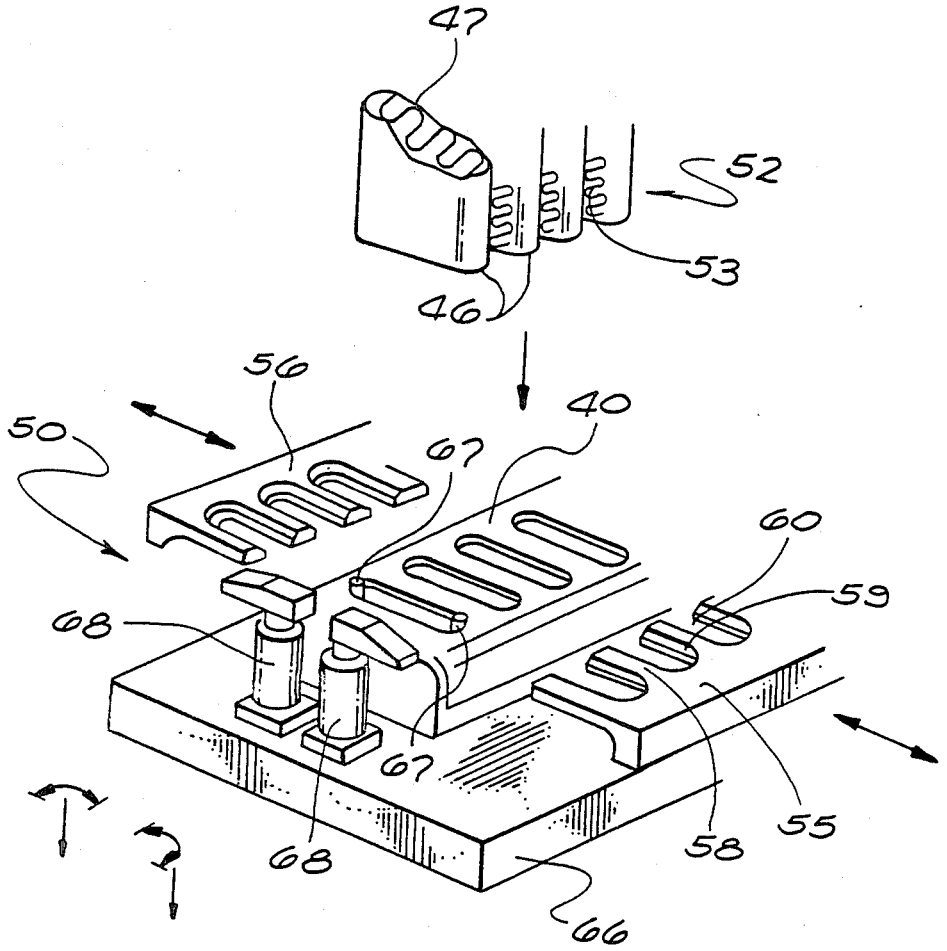
FIG. 4 is a partial plan view of an alignment tool used during insertion of the heat exchanger sub-assembly into the leadless header plate according to the present invention.

Shown in FIG. 4 is an alignment tool 50 which is used to assemble a heat exchanger heater core sub-assembly 52 to the leadless header plate 40 of the present invention. Shown is the sub-assembly 52 which comprises a plurality of elongated heat exchanger tubes 46 separated by a plurality of cooling fins 53. Tubes 46 and cooling finds 53 are first secured together by mechanical means such as strapping. Additionally, tubes 46 can internally contain cooling fins 47 for increased heat exchange capacity if required, see FIGS. 5 and 6. Any desired length heat exchanger core can be built by using the appropriate number and size heat exchanger tubes and cooling fins.

Alignment tool 50 comprises two matching halves, 55 and 56, which are parted longitudinally. Each half has alternating webs 58 and slots 60 which are perpendicular to the parting line. On the top portion of the tool, the transition from each web 58 to each slot 60 includes a tapered section 59. Taper section 59 provides a lead-in when the tube 46 is pressed into the leadless header plate slot 44.

Alignment tool 50 performs several functions: it aligns the heat exchanger tubes 46 with their respective heater plate slots, it guides the tube ends into the proper alignment to fit into the slot in the header plate, it permits simultaneous insertion of a plurality of tubes without adversely deforming the tubes and adjacent cooling fins, and it allows for removal of the tool from the assembled heat exchanger core.

Figure 7:
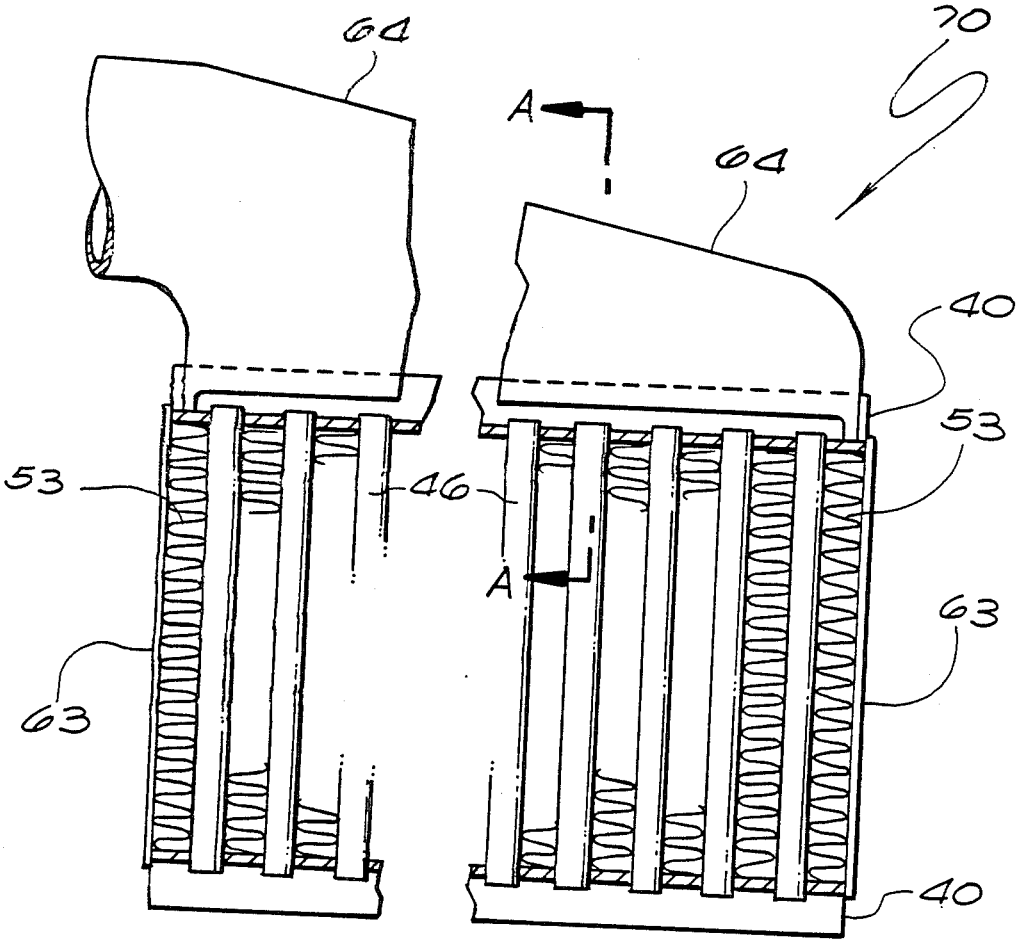
FIG. 7 is a plan view of a typical heat exchanger enploying the leadless header plate of the present invention.
Figure 7A:
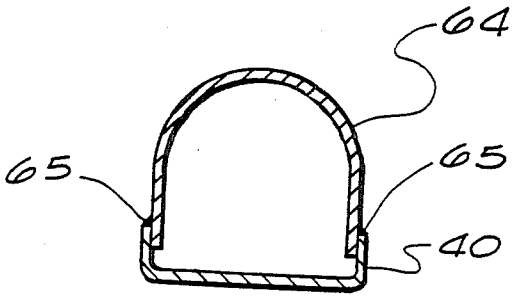
FIG. 7A is a partial cross-sectional view of the manifold portion of the heat exchanger taken along line A—A of FIG. 7.

As shown in FIG. 7, the heat exchanger 70 comprises a sub-assembly 52 and a leadless header plate 40 attached to the top and bottom thereof, a manifold 64 attached to each header plate 40 (only one manifold is shown) and end plates 63 which complete the two outermost flow passages through cooling fins 53. Manifolds 64 are welded or brazed to the header plates 40 at 65 and can be of any particular design and shape as long as it can be secured to header plate 40 in a manner to seal the two in an air tight relationship.

The design of the heat exchanger and in particular the envelope within which the heat exchanger is to fit is dictated by the vehicle manufacturer. Within the space provided it is important to maximize the performance of the heat exchanger by maximizing the heat transfer surface area.

EXAMPLE

The limitation placed upon the heat exchanger by the vehicle manufacturer is that the header plate width is not to exceed 3.03" outside dimension. Structure considerations require that the header plate have a material thickness of 0.125 inches. After forming the header plate into its U-shape as shown in FIG. 3, the inside dimension of the header plate is approximately 2.760 inches. This is equal to the width of the heat exchanger tubes to be used. Unlike the prior art, this size tube can fit within a header plate having a 3.03" outside diameter. As shown in FIG. 2, conventional header plate slots of equal length (2.760 inches) require a header plate having a larger width (3.260 inches) due to the overlapping of the material at the tube lead-in side (the top as shown in FIG. 2).

Figure 5:
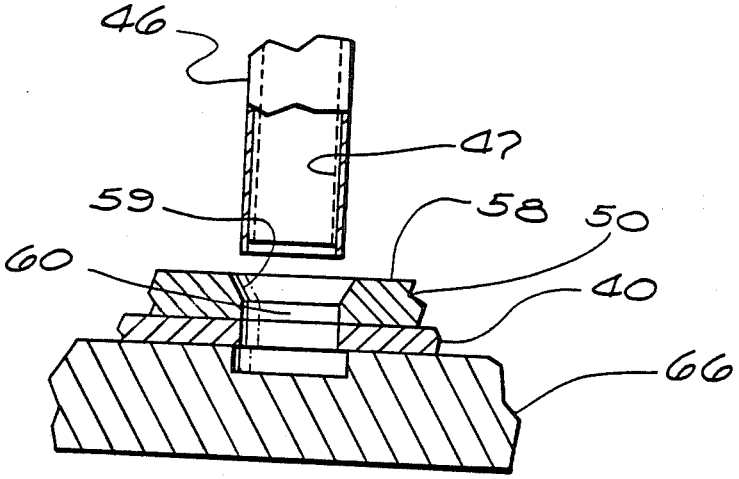
FIG. 5 is a partial cross-sectional view of the leadless header plate and alignment tool prior to insertion of the heat exchanger tube.
Figure 6:
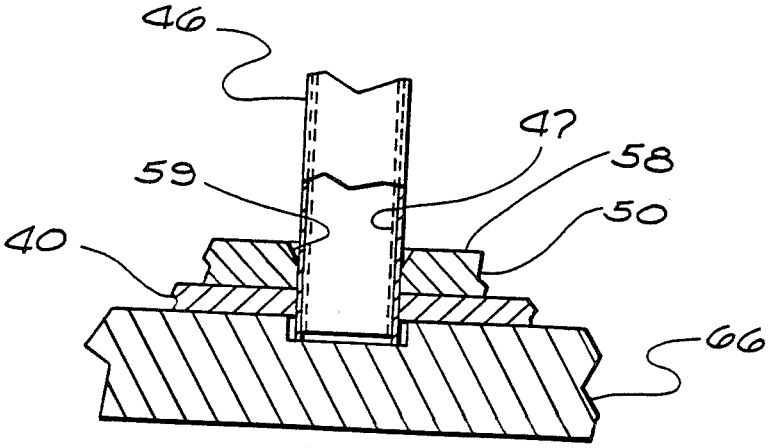
FIG. 6 is a partial cross-sectional view of the leadless header plate, and alignment tool after insertion of the heat exchanger tube.

The method of assembling the heat exchanger of the present invention is shown in FIGS. 4–6. A slotted leadless header plate 40 is loaded onto a base fixture 66. The alignment tool 50 is activated and the two halves 55 and 56 are horizontally moved toward each other as shown by the arrows. The halves are positioned in their proper alignment over the slotted header plate 40 by retractable locating pins 67 that extend from the base fixture 66 and protrude through the slots in the header plate and alignment tool. FIG. 4 shows only two locating pins 67, a similar set of pins is also located in the last slot at the other end of leadless header plate 40. At each end of the header plate 40 are clamps 68 which include arms which rotate over the alignment tool 50. Clamps 68 are retracted downward so as to hold the alignment tool 50 and the slotted leadless header plate 40 in place on the base fixture 66. The locating pins 67 are then retracted.

A heater core sub-assembly 52 comprising alternating tubes 46 and cooling fins 47 is then placed in the alignment tool 50. The open ends of the tubes are nestled in the tapered area 59 of the alignment tool slots 60. A hydraulic press (not shown) is activated and presses the tube ends into the slots 44 of leadless header plate 40 as shown in FIG. 6. The clamps 68 and alignment tool halves 55 and 56 are retracted. The operation is then repeated for the other end of the heater core sub-assembly. Thereafter, manifolds 64 are included or brazed to the heater core to form the intercooler 14 for use in the turbocharged engine system. Furthermore, it should be clear that any number of heat exchanger cores can be secured together in end to end relationship to construct a core of desired length.

Various modifications to the depicted and described apparatus will be apparent to those skilled in the art. Accordingly, the foregoing detailed description of the preferred emboidment should be considered exemplary in nature, and not as limiting to the scope and spirit of the invention as set forth in the appended claims.

Having described the invention with sufficient clarity that those skilled in the art may practice it, I claim:

1. A leadless header plate comprising:

a generally flat base portion defining a plurality of slots therein and legs on either side of and running the length of the base portion, said base portion and legs being integrally formed and forming a generally flattened U-shaped cross-section, each of said slots having a length equal to the distance between said legs.

2. The header plate of claim 1 wherein said slots are parallel to each other.

3. The header plate of claim 2 wherein said slots are generally elongated across said base portion.

4. A heat exchanger comprising:

a plurality of tubes in spaced, side-by-side relationship;

cooling fins between said tubes and attached thereto;

a header plate at each end of said plurality of tubes, said header plates including a base portion having a width and legs integral to each side of the base portion and running the length of said base portion, said plate having a generally U-shaped cross section, said base portion defining a plurality of slots having a length equal to the width of the base portion;

means for securing said tubes to said header plates; and end plates secured to the end of said header plates in parallel relationship with said tubes;

manifold means attached to each of said header plates and forming a fluid tight chamber therebetween for collecting and dispersing fluid to said plurality of tubes.

5. The heat exchanger of claim 4 wherein said tubes are of equal length.

6. The heat exchanger of claim 5 wherein said tubes include cooling fins internal thereto.

7. The heat exchanger of claim 6 wherein said tubes are generally elongated in cross-section.

8. The heat exchanger of claim 4 wherein the width is approximately equal to the length of the slot plus twice the thickness of the material used to form the heat exchanger.

9. The heat exchanger of claim 4 wherein said tubes are equally spaced from one another.

10. The heat exchanger of claim 4 wherein said means for securing is braze between the legs of the header plate and the tube and along the interface between the tube and the base portion defining the slot.

* * * * *